United States Patent [19]

Cros

[11] 3,944,103

[45] Mar. 16, 1976

[54] TWO-PIECE PLASTIC CLOSURE

[76] Inventor: Modesto Cros, "Les Cedres", Route de Molles, 03300 Cusset, France

[22] Filed: May 2, 1974

[21] Appl. No.: 466,479

[30] Foreign Application Priority Data

May 2, 1973 France ..... 73.15683

[52] U.S. Cl. ..... 215/277; 215/320; 215/350

[51] Int. Cl.[2] ..... B65D 51/18

[58] Field of Search ..... 215/277, 320, 329, 341, 215/350, 354

[56] References Cited

UNITED STATES PATENTS

| | | | |
|---|---|---|---|
| 2,068,389 | 1/1937 | Smith | 215/350 |
| 3,249,248 | 5/1966 | Metzendorf | 215/334 |
| 3,684,118 | 8/1972 | Brumme | 215/320 X |
| 3,696,957 | 10/1972 | Van Baarn | 215/320 |

*Primary Examiner*—Donald F. Norton

[57] ABSTRACT

In this two-piece closure for sealing containers, abutment, retaining and locking means are provided on the one hand on a flange of the main or inner cap and on the other hand on the bottom and/or inner surface of the skirt of the outer cap, said means co-acting with each other for securing the main cap flange in said outer cap, without any play, relative movement and flange distortion.

4 Claims, 9 Drawing Figures

TWO-PIECE PLASTIC CLOSURE

BACKGROUND OF THE INVENTION

The present invention relates in general to plastic closures or caps for bottles and other containers formed with a retaining external bead at the outer end of their neck. More particularly, this invention is directed to provide a plastic closure of this general type, which comprises an outer skirted closure cap adapted to be assembled either during the closure manufacturing process or at the time of actual use with an inner or main closure cap forming with said outer cap a double walled space adapted to receive a product.

The chief difficulty to be overcome in devices of this type lies in the means used for securing the outer skirted cap to the inner cap constituting the stopper proper so that the dual feature of a faultless assembling and the absence of any relative movement between these elements be obtained while warranting and preserving a constant fluidtightness, especially with gaseous products. Another difficulty resides in the fact that the relative fastening of these elements must be reversible so that the inner cap can be removed from the outer cap, for example when it is desired to release the product contained in said double wall.

This fluid-tight closure consisting of two elements adapted to be firmly assembled and reversible at will comprises a main, inner cup-shaped closure cap formed with an integral peripheral flange, and an outer cap formed with an external skirt co-acting with the side wall of said main cap to provide an annular space adapted, when fitting the closure with a moderate forcing, to receive the neck of a container until the edge of said neck abutes a peripheral rib formed on the inner surface of said skirt and somewhat spaced from the bottom of said outer cap.

The external skirt of the outer cap of the two-piece closure according to this invention may comprise as already known per se a downward extension from which it is separated by at an incipient tearing or breaking line, said extension constituting a guarantee strip formed wth an integral tear-off lug, whereby the closure constitutes a definitely temper-proof device.

SUMMARY OF THE INVENTION

According to this invention, abutment, retaining and locking means are provided on the one hand on the main or inner cap flange and on the other hand on the bottom and/or inner surface of the skirt of the outer cap, said means cooperating with one another for securing the main cap flange in said outer cap, without any play, relative movement and flange distortion.

These abutment, retaining and locking means comprise on the one hand, on said main or inner cap, at least one circular bead extending along the whole or part of the lower flange face and a milled outer edge of said flange, and on the other hand on said outer cap a milled circular portion formed on the inner surface of the skirt of said outer cap and registering with the milled outer edge of said flange, so that both milled portions can "mesh" with each other.

This milling may also be provided on the upper or lower surface of the main or inner cap and on corresponding surface areas of the outer cap.

These means for fastening the outer and inner caps together comprise on the other hand in the bottom and/or the inner wall of said outer cap stop-forming projections adapted to lock the main cap flange in the groove formed in the inner surface of the outer cap skirt by forming a peripheral rib somewhat spaced from the bottom of said outer cap.

Alternatively, the stop-forming projections may be formed on the main cap flange in the form of a series of spaced projecting studs, which achieve the same standing and locking means of the inner cap flange in the bottom of the outer cap. When the inner cap is put on the container, the outer edge of his flange is disengaged from the fitting on the container and his penetration by juncture in the groove formed correspondantly in the inner face of the outer cap is maked easier without distortion of the inner cap.

BRIEF DESCRIPTION OF THE DRAWINGS

The features and advantages characterising this invention will appear more completely as the following description proceeds with reference to the attached drawings, in which.

DESCRIPTION OF THE PREFERRED EMBODIMENT

Figure 1:
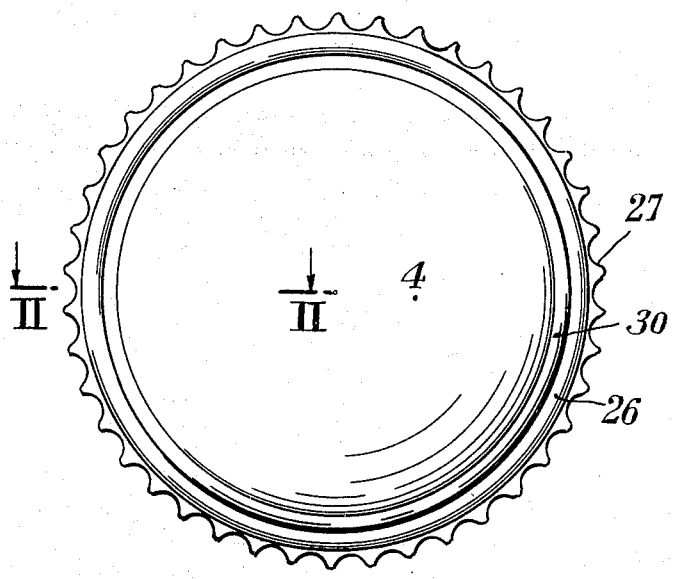
FIG. 1 is a plane view from beneath showing the main or inner cap with its integral flange having a milled or castellated edge.
Figure 2:
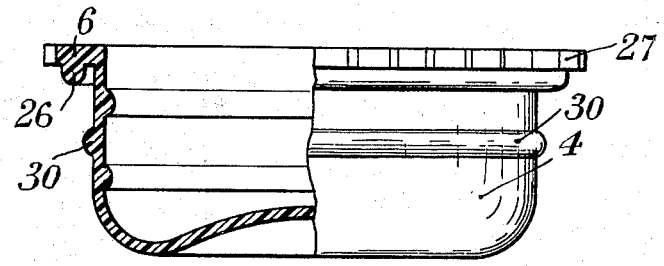
FIG. 2 is an elevational view with a portion shown in section taken along the line II—II of FIG. 1.

In the embodiment illustrated in FIGS. 1 to 5 inclusive, the inner or main cap 4 comprises an annular flange 6 having one or more circular beads 26 formed on its inner or lower face, the outer edge of this flange 6 being milled or cogged as shown at 27 (see FIGS. 1 and 2).

Figure 3:
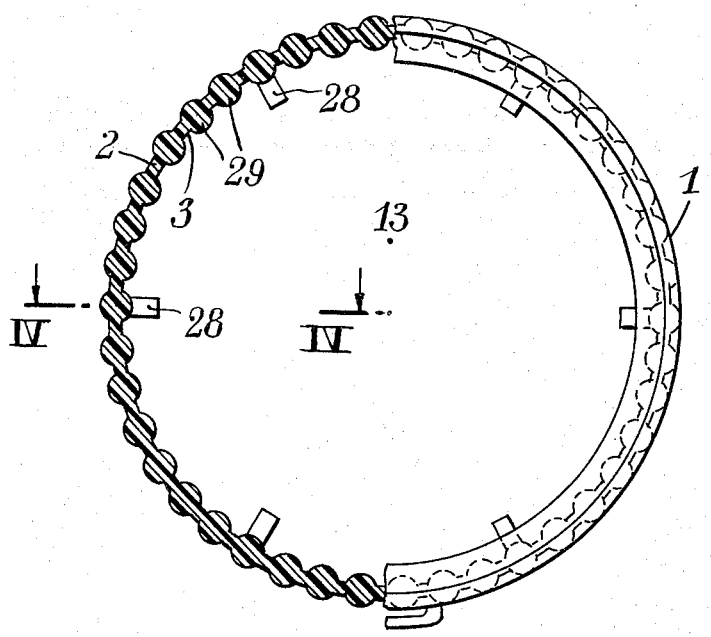
FIG. 3 is a plane view from beneath of an outer cap with a portion shown in section taken along the line III—III of FIG. 4.
Figure 4:
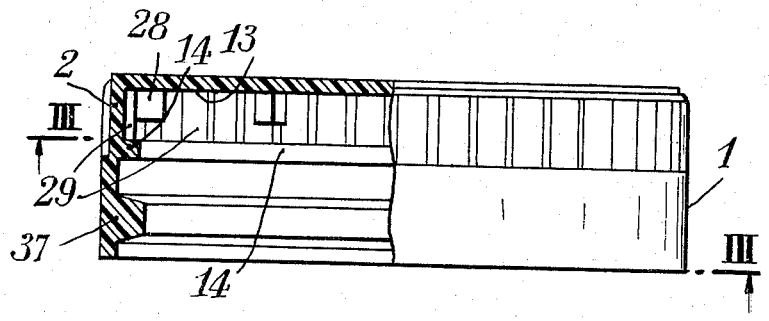
FIG. 4 is an elevational view partly in section taken along the line IV—IV of FIG. 3.

A milled or cogged portion 29 matching the milled or cogged portion 27 is formed on the inner surface of the skirt 2 of the outer cap 1 (see FIGS. 3 and 4).

This outer cap 1 further comprises spaced inner studs 28 adapted to lock and position the flange 6 of the main cap 4 in the groove 3 provided by the circular rib 14 of said outer cap 1.

Figure 9:
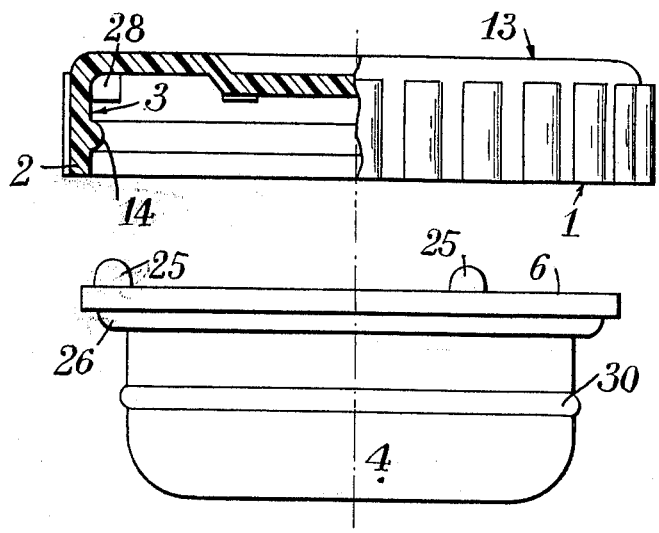
FIG. 9 is an exploded view of a modified form of embodiment of the outer cap and inner cap assembly.

The number and disposition of these studs 28 on the inner face of the bottom 13 of outer cap 1, and adjacent the externally milled skirt 2, are variable so that said studs 28 project inwardly (FIG. 9). The milled portion 29 of said flange 6 engages the milled portion 27 of main cap 4 like matching gears meshing with each other, when the device is fitted to the bottle of a container. With this arrangement, any relative rotation of main cap 4 and outer cap 1 is safely prevented. The studs 28 of outer cap 1 are further adapted, under all circumstances, to properly position the main cap 4 by preserving a certain play between the flange 6 of main cap 4 and the bottom 13 of outer cap 1, and the milled portions 29 and 27 engage one another to prevent any untimely movement of the main cap 4 when the outer cap 1 is fitted thereon.

Figure 5:
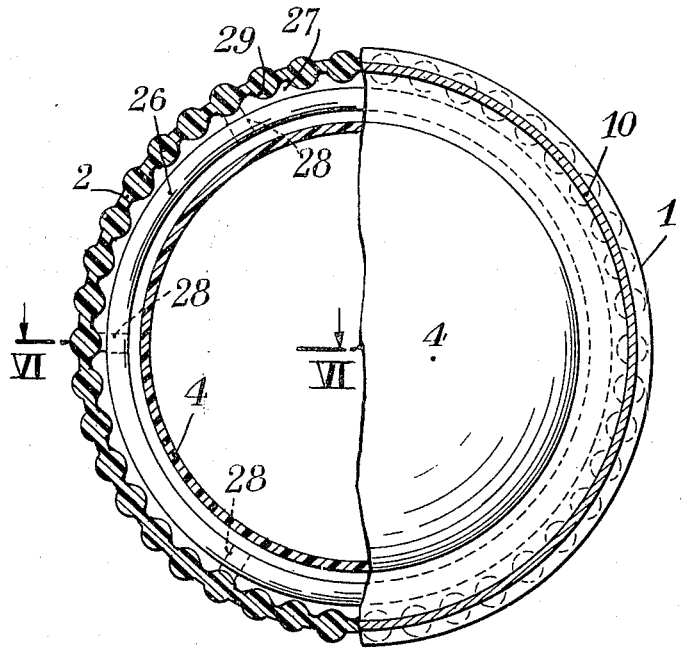
FIG. 5 is a plane view from beneath with a partial section taken along the line V—V of FIG. 6, showing the main cap assembled with the outer cap and fitted to the neck of a container.
Figure 6:
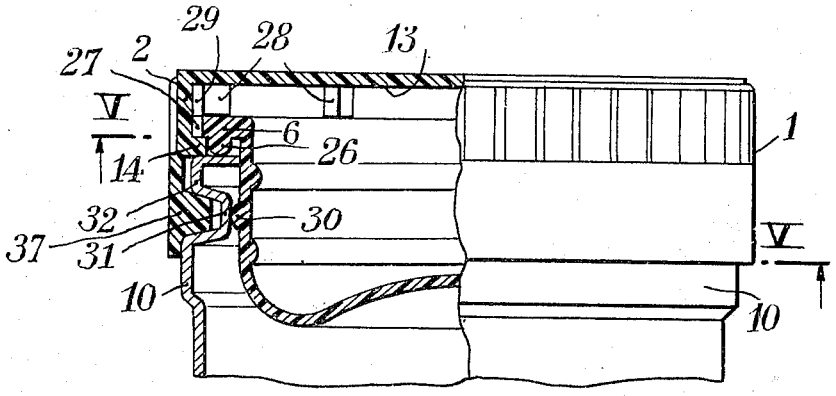
FIG. 6 is an elevational view with a partial section taken along the line VI—VI of FIG. 5.

FIGS. 5 and 6 illustrate the two-piece closure assembly comprising the main or inner cap 4 of FIGS. 1 and 2, and the outer cap 1 of FIGS. 3 and 4, fitted on the neck 10 of a container taken by way of example.

The main cap 4 is fitted on the neck 10 by using conventional capping machines. Then the outer cap 1 is positioned to cover the inner cap by the same machine; the flange 6 of main cap 4 is thus positioned in relation to the bottom 13 of outer cap 1 due to the presence of studs 28, and retained in the groove 3 formed by the rib 14 projecting inwardly from the inner surface of skirt 2; the notches or teeth 27 and 29 in relative meshing engagement counteract any relative movement between the inner and outer caps.

For reasons of fluid-tightness, the main or inner cap 4 has formed on its outer surface a circular bead 30 adapted resiliently to engage the bottom of the groove 31 formed in the neck 10 of the container, under the top edge 32 thereof.

Figure 7:
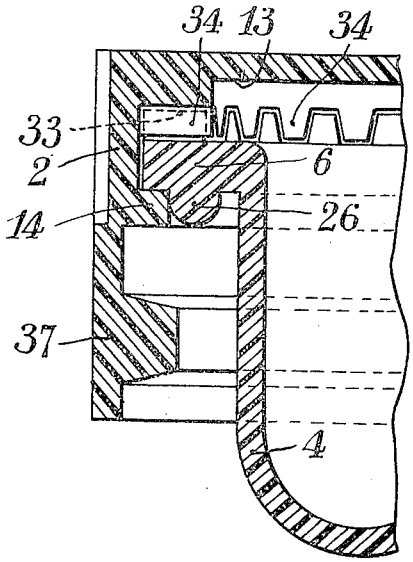
FIG. 7 is a sectional view showing on a larger scale a modified form of embodiment of the means for interlocking the inner or main cap and the outer cap by means of milled or cogged portions of the upper face of the flange.
Figure 8:
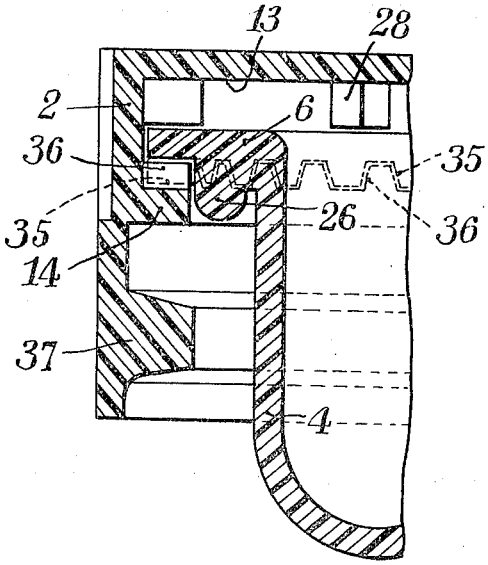
FIG. 8 is a similar sectional view of another modified embodiment with a milled or cogged portions of the top of said flange.

The means for interlocking the main cap 4 and outer cap 1 by mutual engagement of the milled portion of flange 6 and the matching milled portion of the inner surface of the outer cap 1 may be embodied differently, as illustrated by way of example in FIGS. 7 and 8, without departing from the basic principle of the invention.

Thus, in FIG. 7, the top face 33 of flange 6 is milled and meshes with a matching milled portion 34 formed in the bottom 13 of the upper or outer cap 1.

In contrast thereto, as shown in FIG. 8, these studs 28 are maintained and the milled portion of the lower face 35 of flange 6 adjacent the bead 26 is caused to mesh with a matching milled portion 36 formed on the rib 14 of skirt 2 of outer cap 1.

In the modified form of embodiment of the main cap 4, as shown in FIG. 9, the means for rendering the flange 6 independent while safely assembling the inner and outer caps 4, consists in forming on the underface of said flange a continuous or discontinuous bead 26 adapted to engage the neck of the container and also the projecting studs 25 formed on the top of said flange 6, and to coact with studs 28 formed on the outer cap 1. Thus, when the inner or main cap 4 penetrates into the outer or upper cap 1, the flange 6 fits snuggily in the groove 3 of skirt 2, which is formed by the rib 14, as shown.

The projecting studs 25 abut the side of the studs 28 and prevent the rotation of the inner cap in the outer cap, as the milling of the precedent forms.

The above-described closure is characterised by the following advantages with respect to hitherto known devices of this type:

1. The liquid contained in the bottle or like container is isolated from the surrounding atmosphere by two walls spaced a sufficient distance a part to prevent any movement due to osmosis pollution and evaporation of the liquid by the atmosphere, in lieu of the customary single polyethylene or similar plastic wall.

2. The inner overpressure caused by a temperature increment acts against the bottom of the inner cap 4, thus expanding same against the inner wall of the neck of the container, so that the fluid-tightness is not only preserved but improved.

3. Re-fitting the closure is a particularly easy operation since the rounded portion of the main cap 4 fits readily and without undergoing any appreciable distortion in the neck of the container, in contrast with conventional devices of this character which comprise reinforcing inner ribs or the like for causing the inner skirt of the closure to be pressed with a sufficient force against the inner wall of the neck.

4. The mass production of this closure is particularly economical due to the simplified design of the mold impressions for making the two elements, and also to the easy assembling thereof.

5. The use of a two-piece closure permits of utilizing different materials for each type of element; thus, the main cap material may be colored, without any inconvenience, since the bottle content is not in direct contact therewith.

6. The fluid-tight space reserved between the main cap 1 and outer cap 4 may be used for holding a product to be mixed up with the content of the main container after removing the closure.

7. The gurantee strip possibly provided at the lower end of the skirt 2 of the outer cap 1 will free a two-piece closure adapted to constitute a box with its lid.

8. Any shock applied to the outer cap 1 will not have any detrimental effect on the main cap 4.

9. The closure may be supplied either as a single unit or alternatively the outer cap 1 may be fitted in position when stopping the container with the main cap.

What is claimed is:

1. Two-component plastic tight closure comprising on the one hand a cup-shaped bottom (4) adapted to be driven into the neck of a container, which comprises an annular flange (6) surrounding its top edge, said flange (6) having formed on at least one portion of its lower annular surface a circular bead (26) and along its outer cylindrical edge locking means (25, 27) and on the other hand a cap (1) having a depending skirt (2) adapted to fit on said cup-shaped bottom (4) and formed along the periphery of its top portion (13) with means (28) for abutting said flange (6) of said cup-shaped bottom and projections adapted to engage said locking means (25, 27) of said cup-shaped bottom.

2. Closure as set forth in claim 1, wherein said locking means are formed on the top surface of the flange of said cup-shaped bottom and consist of studs (25), and said means (28) for abutting said flange also comprise said projections of said cap and consist of lugs.

3. Closure as set forth in claim 1, wherein said locking means of said cup-shaped bottom (4) consist of indentations (27) formed along the edge of said flange and said projections of said cap consist of a milled inner portion of said skirt (2).

4. Closure as set forth in claim 1, which comprises on the inner surface of said skirt (2) of said cap a circular rib (14) adapted to support the edge of the flange of said cup-shaped bottom.

* * * * *